US012553213B2

(12) United States Patent
Otsuka

(10) Patent No.: US 12,553,213 B2
(45) Date of Patent: Feb. 17, 2026

(54) CONSTRUCTION MACHINE

(71) Applicant: Yanmar Holdings Co., Ltd., Osaka (JP)

(72) Inventor: Yosuke Otsuka, Chikugo (JP)

(73) Assignee: YANMAR HOLDINGS CO., LTD., Osaka (JP)

( * ) Notice: Subject to any disclaimer, the term of this patent is extended or adjusted under 35 U.S.C. 154(b) by 427 days.

(21) Appl. No.: 18/269,140

(22) PCT Filed: Dec. 7, 2021

(86) PCT No.: PCT/JP2021/044834
§ 371 (c)(1),
(2) Date: Jun. 22, 2023

(87) PCT Pub. No.: WO2022/138126
PCT Pub. Date: Jun. 30, 2022

(65) Prior Publication Data

US 2024/0084551 A1 Mar. 14, 2024

(30) Foreign Application Priority Data

Dec. 22, 2020 (JP) ..... 2020-212336

(51) Int. Cl.
*E02F 9/08* (2006.01)

(52) U.S. Cl.
CPC ..... *E02F 9/0866* (2013.01)

(58) Field of Classification Search
CPC ..... E02F 9/0866
See application file for complete search history.

(56) References Cited

U.S. PATENT DOCUMENTS 9,334,626 B2 * 5/2016 Iwamoto ..... E02F 9/16
11,413,955 B2 * 8/2022 Yamamoto ..... F01P 3/18
12,385,217 B2 * 8/2025 Miura ..... E02F 9/0883
(Continued)

FOREIGN PATENT DOCUMENTS

JP 10-322915 A 12/1998
JP 2006074988 A 3/2006
JP 2007-077700 A 3/2007
(Continued)

OTHER PUBLICATIONS

Japanese Office Action dated Jul. 11, 2023 issued for JP Application No. 2020212336.

(Continued)

*Primary Examiner* — Bryan A Evans
(74) *Attorney, Agent, or Firm* — NORTON ROSE FULBRIGHT US LLP

(57) ABSTRACT

A construction machine includes an engine, a cooling fan, a hood, a heat exchanger, a partition plate, a battery, and a fuse box. The engine has electrical equipment. The cooling fan is mounted to the engine. The hood has an exhaust port. The heat exchanger is disposed between the cooling fan and the exhaust port. The partition plate defines an exhaust air channel between the heat exchanger and the exhaust port. The battery is disposed in a space under the partition plate. The fuse box is connected to a circuit joining the electrical equipment of the engine and the battery. The fuse box is disposed between the battery and the partition plate.

6 Claims, 8 Drawing Sheets

(56) References Cited

U.S. PATENT DOCUMENTS

2007/0163826 A1 7/2007 Youn

FOREIGN PATENT DOCUMENTS

| | | | |
|---|---|---|---|
| JP | 2009035956 | A | 2/2009 |
| JP | 2009056918 | A | 3/2009 |
| JP | 2010108718 | A | 5/2010 |
| JP | 2013087542 | A | 5/2013 |
| JP | 2013091927 | A | 5/2013 |
| JP | 2013-189785 | A | 9/2013 |
| JP | 2014184946 | A | 10/2014 |
| JP | 2015137524 | A | 7/2015 |
| JP | 2018135702 | A | 8/2018 |
| JP | 2022098755 | A | 7/2022 |

OTHER PUBLICATIONS

Japanese Office Action dated Nov. 28, 2023 issued for JP Application No. 2020212336.
International Search Report dated Jan. 25, 2022 issued in corresponding PCT Application PCT/JP2021/044834.
Japanese Office Action mailed on Aug. 26, 2025, issued in JP Application No. 2024-099430.

* cited by examiner

CONSTRUCTION MACHINE

CROSS-REFERENCE TO RELATED APPLICATIONS

This application is a national stage application pursuant to 35 U.S.C. § 371 of International Application No. PCT/JP2021/044834, filed on Dec. 7, 2021, which claims priority under 35 U.S.C. § 119 to Japanese Patent Application No. 2020-212336 filed on Dec. 22, 2020, the disclosures of which are hereby incorporated by reference in their entireties.

TECHNICAL FIELD

The present invention relates to a construction machine.

BACKGROUND ART

In a construction machine described in Patent Document 1, a fuel tank is arranged adjacent to the front of an engine arranged at a rear portion, and a battery and a fuse box are arranged at the side of the fuel tank.

PRIOR ART DOCUMENT

Patent Document

Patent Document 1: JP-A-2007-77700

SUMMARY OF INVENTION

Technical Problem

In the construction machine described in Patent Document 1, not only a harness connecting an engine-related electric device to the battery and the fuse box is long, but also it is hard to say that the space of an engine room housing the engine is effectively utilized.

An object of the present invention is to provide a construction machine of which the component layout efficiency in an engine room is improved.

Solution to Problem

The construction machine of the present invention includes an engine, a cooling fan, a hood, a heat exchanger, a partition plate, a battery, and a fuse box. The engine has an electric device. The cooling fan is assembled to the engine. The hood has an exhaust opening. The heat exchanger is arranged between the cooling fan and the exhaust opening. The partition plate forms an air discharge passage between the heat exchanger and the exhaust opening. The battery is arranged in a space below the partition plate. The fuse box is connected to a circuit connecting the electric device and the battery to each other. The fuse box is arranged between the battery and the partition plate.

Advantageous Effects of Invention

According to the present invention, the construction machine of which the component layout efficiency in the engine room is improved is provided.

DESCRIPTION OF EMBODIMENTS

Figure 1:
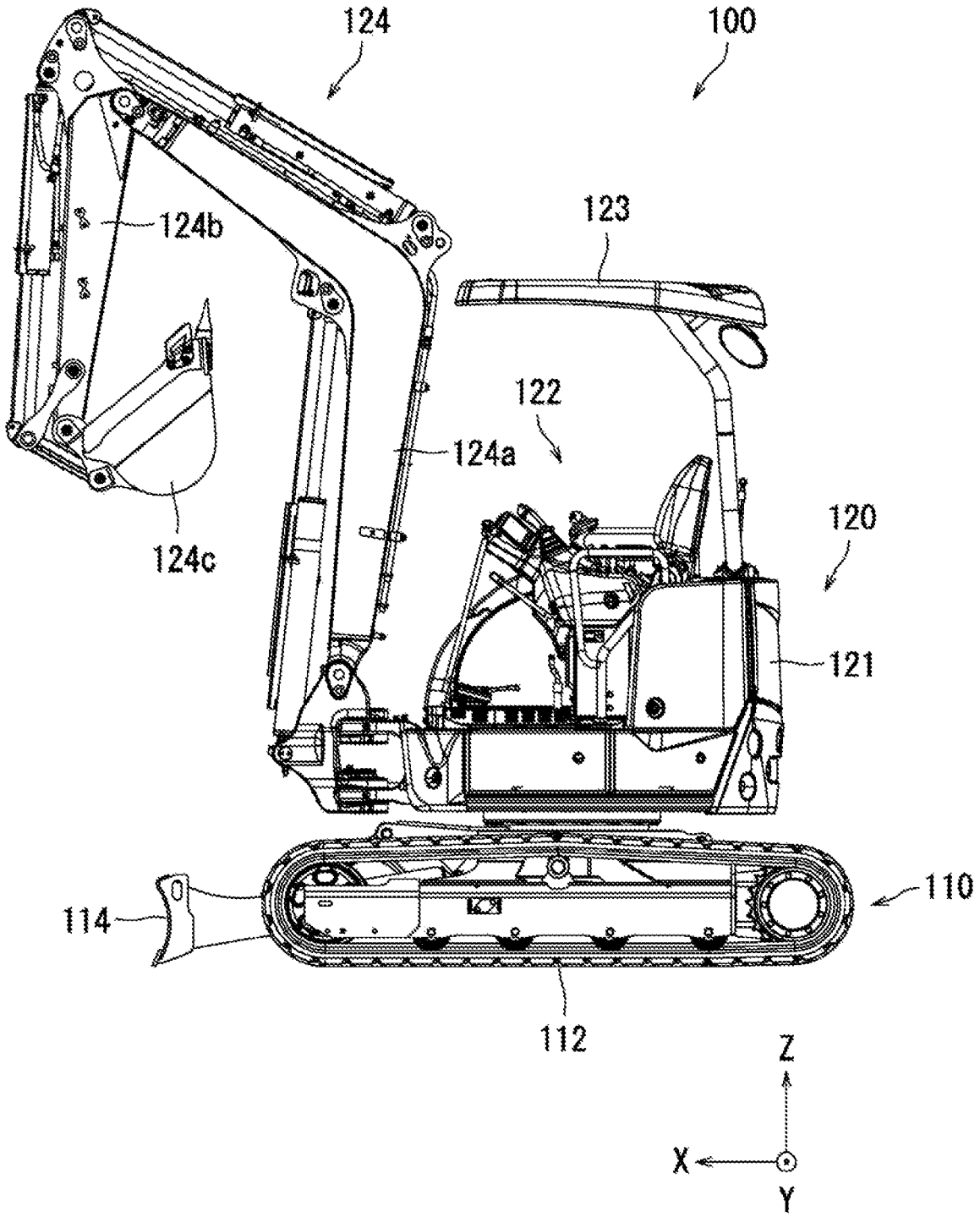
FIG. 1 is a side view showing an example of a construction machine according to an embodiment.

An embodiment of the present invention will be described with reference to the drawings. Note that in the drawings, the same reference numerals are used to represent the same or equivalent elements and description thereof will not be repeated.

A construction machine 100 according to the embodiment will be described with reference to FIG. 1. FIG. 1 is a side view showing an example of the construction machine 100. The construction machine 100 is, for example, an excavator. For the sake of convenience, in FIG. 1, a direction from the right to the left is a positive direction of an X-axis, a direction from the rear to the front is a positive direction of a Y-axis, and a direction from the bottom to the top is a positive direction of a Z-axis.

As shown in FIG. 1, the construction machine 100 includes a lower traveling body 110 and an upper turning body 120. The upper turning body 120 is turnable relative to the lower traveling body 110.

The lower traveling body 110 includes a traveling mechanism 112 and a blade 114. The traveling mechanism 112 is of a crawler type. The blade 114 is used for a soil discharging work and a ground leveling work.

The upper turning body 120 includes a hood 121, a steering unit 122, a canopy 123, and a work machine 124.

The hood 121, the steering unit 122, and the canopy 123 are arranged on an upper portion of the upper turning body 120. The hood 121 forms a substantially semi-cylindrical exterior of the upper turning body 120. The steering unit 122 enables an operator to steer the construction machine 100. The canopy 123 is provided as a canopy for the operator.

The work machine 124 is arranged on the front side of the upper turning body 120. The work machine 124 includes a boom 124*a*, an arm 124*b*, and a bucket 124*c*. The boom 124*a*, the arm 124*b*, and the bucket 124*c* are driven by a hydraulic device in a well-known manner.

Figure 2:
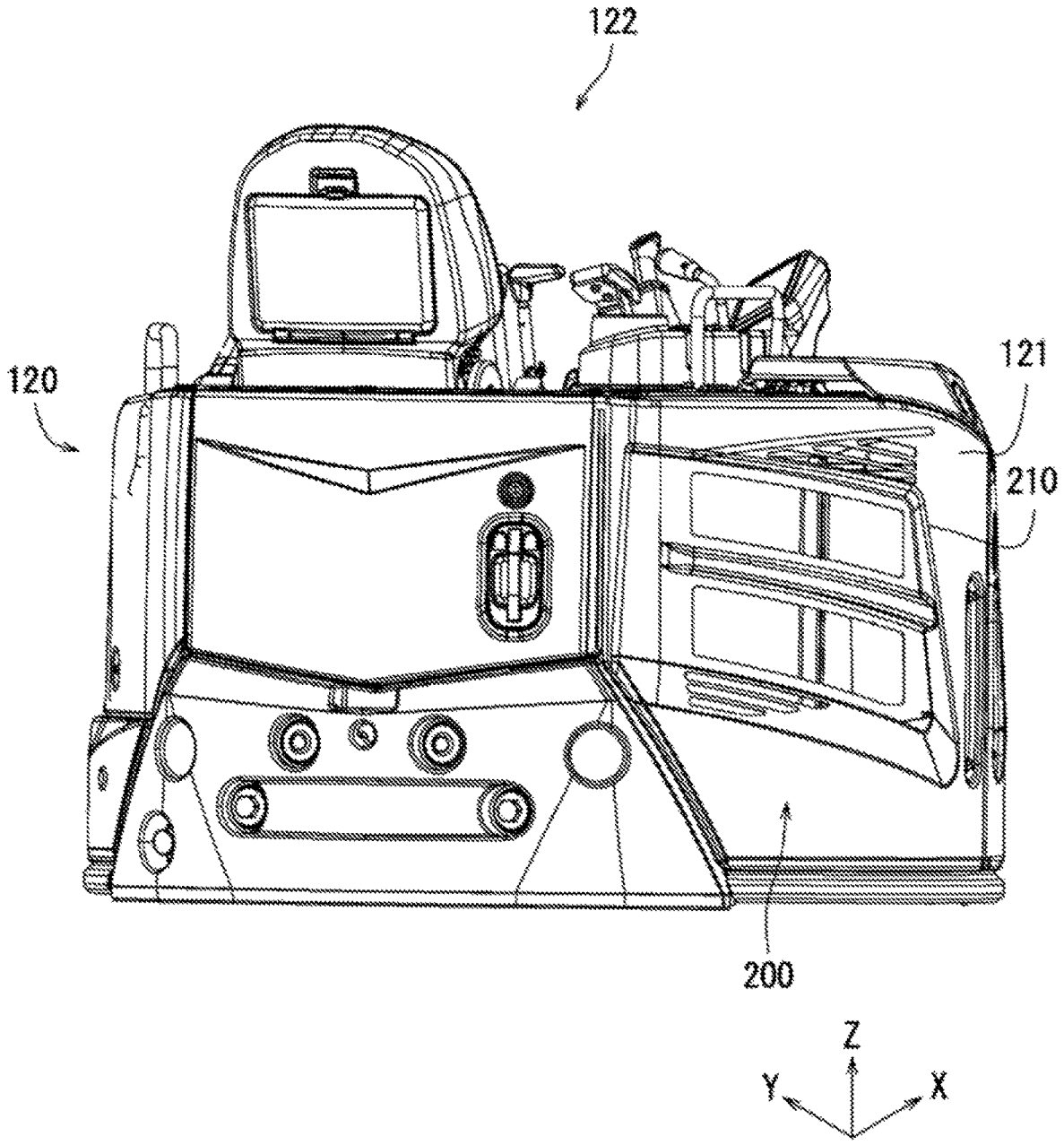
FIG. 2 is a view showing an example of the appearance of a right rear portion of an upper turning body.

Next, the appearance of a right rear portion of the upper turning body 120 will be described with reference to FIGS. 1 and 2. FIG. 2 is a view showing an example of the appearance of the right rear portion of the upper turning body 120.

As shown in FIG. 2, the hood 121 has an exhaust opening 200. The exhaust opening 200 is covered with a grill 210 having a quadrangular shape.

Figure 3:
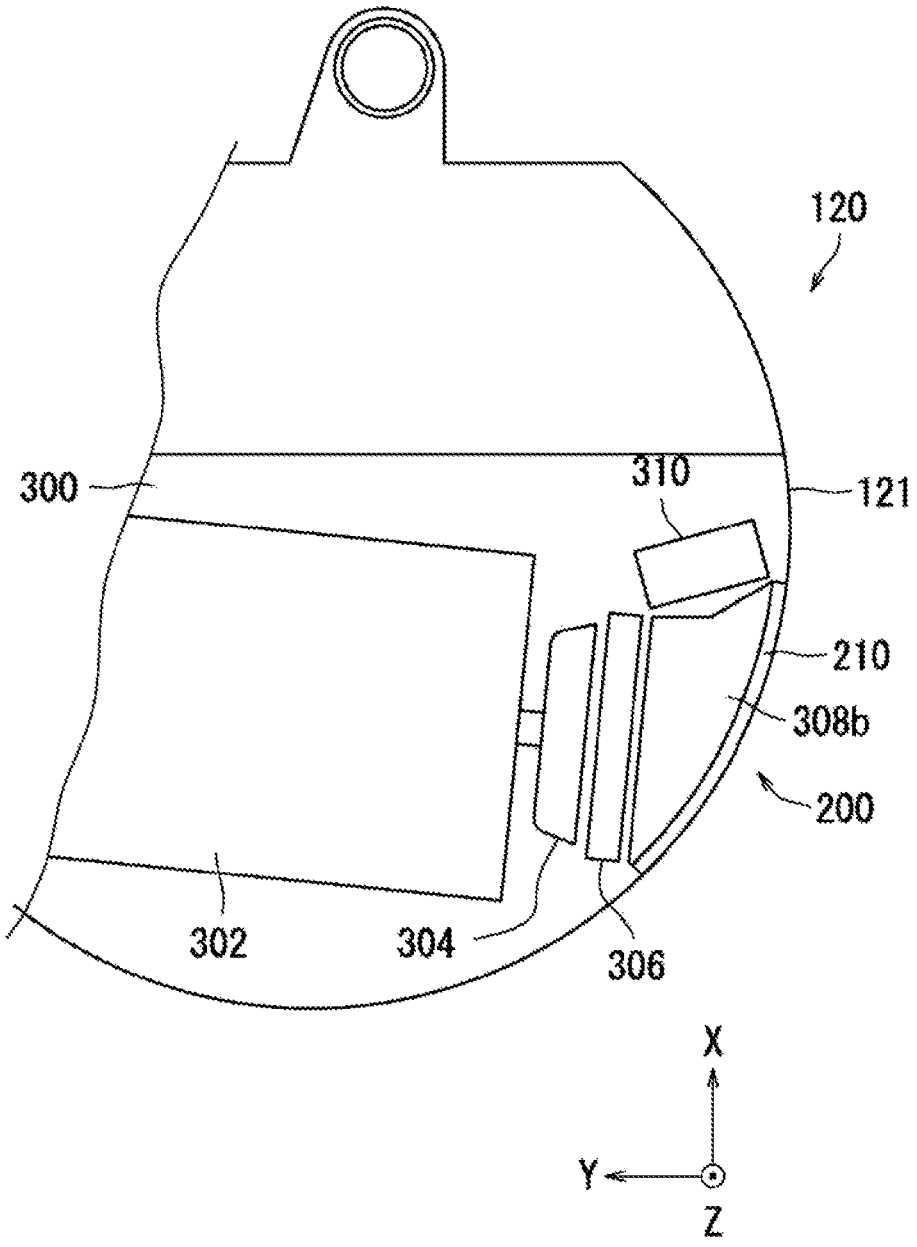
FIG. 3 is a plan view schematically showing an example of component arrangement in an engine room.
Figure 4:
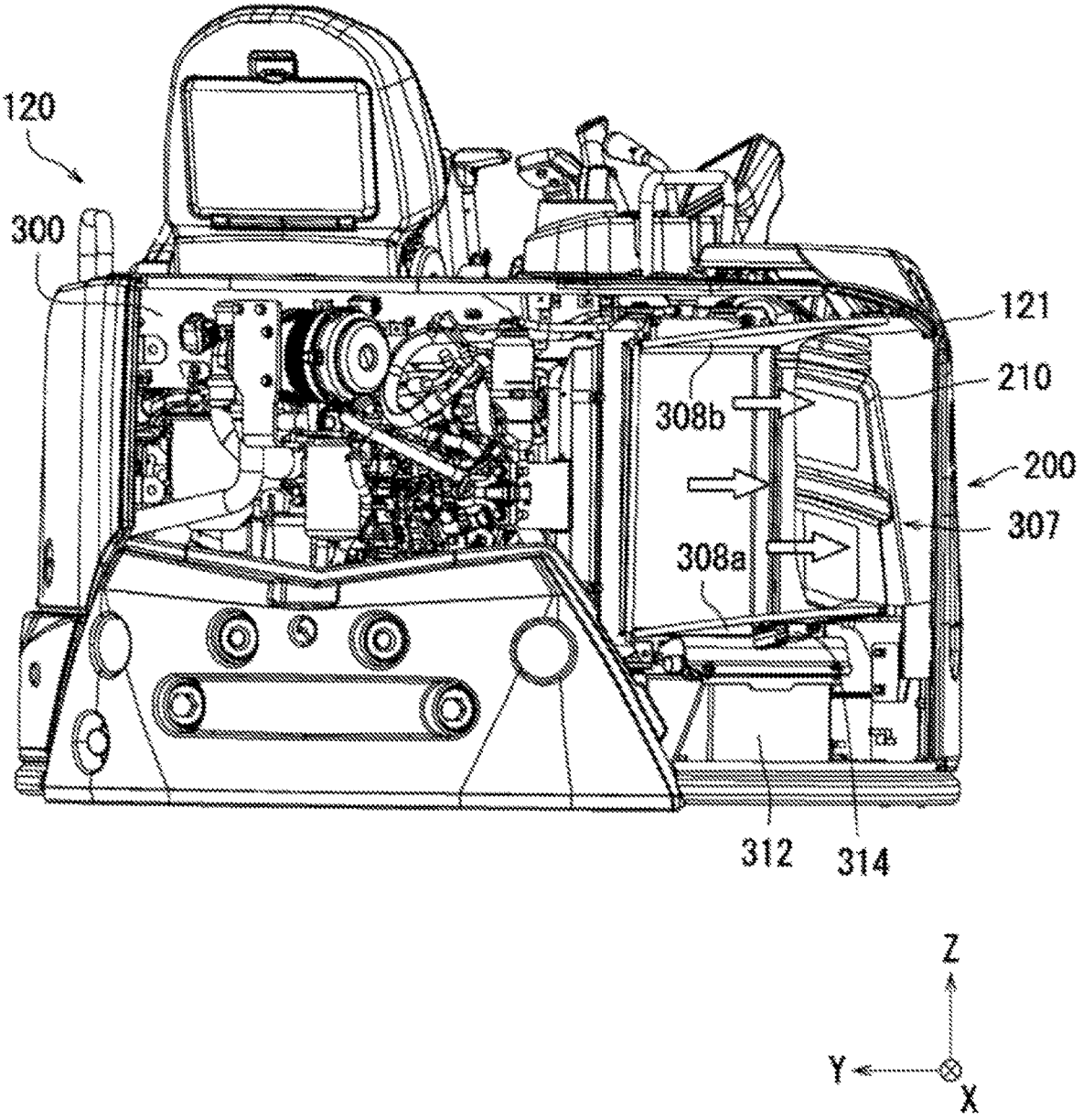
FIG. 4 is a view showing an example of arrangement of a battery and a fuse box.
Figure 5:
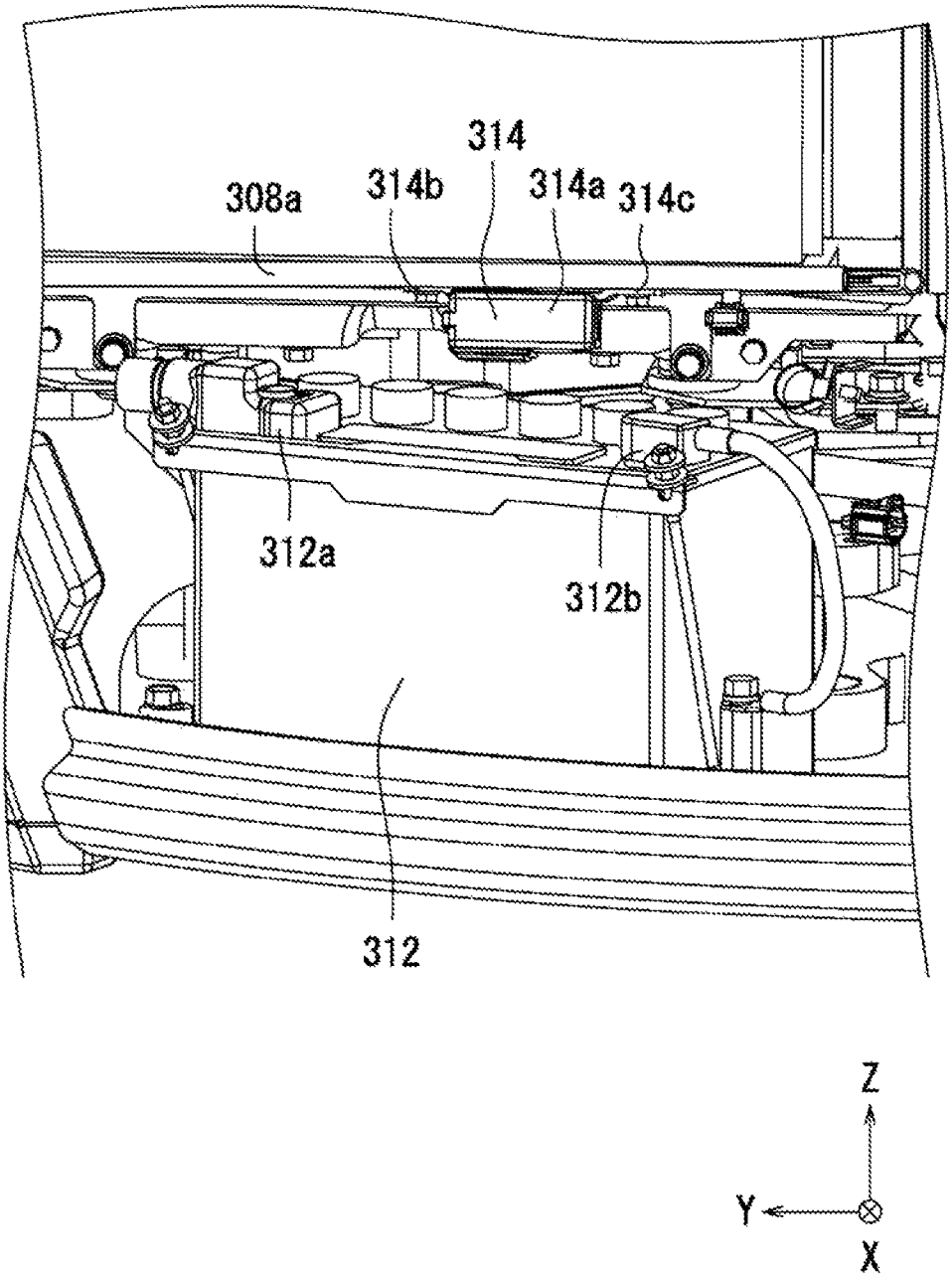
FIG. 5 is an enlarged perspective view of the battery and the fuse box.

Next, component arrangement in an engine room 300 will be described with reference to FIGS. 1 to 5. FIG. 3 is a plan view schematically showing an example of the component arrangement in the engine room 300. FIG. 4 is a view showing a state in which part of the hood 121 is removed from the configuration of FIG. 2, and shows an example of arrangement of a battery 312 and a fuse box 314. FIG. 5 is an enlarged perspective view of the battery 312 and the fuse box 314.

As shown in FIGS. 3 and 4, the engine room 300 is defined below a driver's seat by the hood 121. In the engine room 300, an engine 302, a cooling fan 304, a radiator 306, a lower partition plate 308*a*, an upper partition plate 308*b*, a hydraulic oil tank 310, the battery 312, and the fuse box 314 are arranged. The radiator 306 is equivalent to an example of a "heat exchanger."

The engine 302 is a power source for the construction machine 100, and, for example, is a diesel engine. The engine 302 has an electric device. The cooling fan 304 and a not-shown hydraulic oil pump are assembled to an output shaft of the engine 302. The radiator 306 is arranged between the cooling fan 304 and the exhaust opening 200, and is supplied with coolant for the engine 302. Air sucked through a not-shown suction opening by the suction force of the cooling fan 304 passes through the engine 302, and exchanges heat with the radiator 306. The lower partition plate 308*a* and the upper partition plate 308*b* are plates having a substantially triangular shape. One side of each of the lower partition plate 308*a* and the upper partition plate 308*b* is curved so as to contact the inner surface of the hood 121. The hydraulic oil tank 310 is arranged adjacent to the lower partition plate 308*a* and the upper partition plate 308*b* on the machine body front side, and stores hydraulic oil discharged from the hydraulic oil pump.

As shown in FIG. 4, the lower partition plate 308*a* and the upper partition plate 308*b* form an air discharge passage 307 between the radiator 306 and the exhaust opening 200. Moreover, the lower partition plate 308*a* and the upper partition plate 308*b* are inclined upward in a direction from the radiator 306 toward the exhaust opening 200. Thus, the direction of air discharged from the hood 121 through the exhaust opening 200 is obliquely upward as indicated by arrows in FIG. 4.

The battery 312 is arranged in a space below the lower partition plate 308*a*, and supplies power to the electric device of the engine 302. The fuse box 314 is attached to the surface, which faces downward, of the lower partition plate 308*a* at a position adjacent to the hood 121, and is connected to a circuit connecting the electric device of the engine 302 and the battery 312 to each other.

As shown in FIG. 5, the battery 312 has a positive terminal 312*a* and a negative terminal 312*b*. The fuse box 314 is arranged in a space between the positive terminal 312*a* and the negative terminal 312*b*.

The fuse box 314 has a center portion 314*a*, a first attachment portion 314*b* at one end, and a second attachment portion 314*c* at the other end. The fuse box 314 is attached to the surface, which faces downward, of the lower partition plate 308*a* through the first attachment portion 314*b* and the second attachment portion 314*c*, and the center portion 314*a* is separated from the lower partition plate 308*a* in order to dissipate heat.

The fuse box 314 houses a first fuse and a second fuse. The first fuse is connected to a circuit that discharges the current of the battery 312. The first fuse includes a fuse connected to a circuit of a starting motor for starting the engine 302. Moreover, the first fuse includes a fuse connected to a circuit of a glow plug for easily starting the engine 302 in a cold state. The second fuse is connected to a circuit that charges the battery 312. The second fuse includes a fuse connected to a circuit of an alternator which is a generator.

Figure 6:
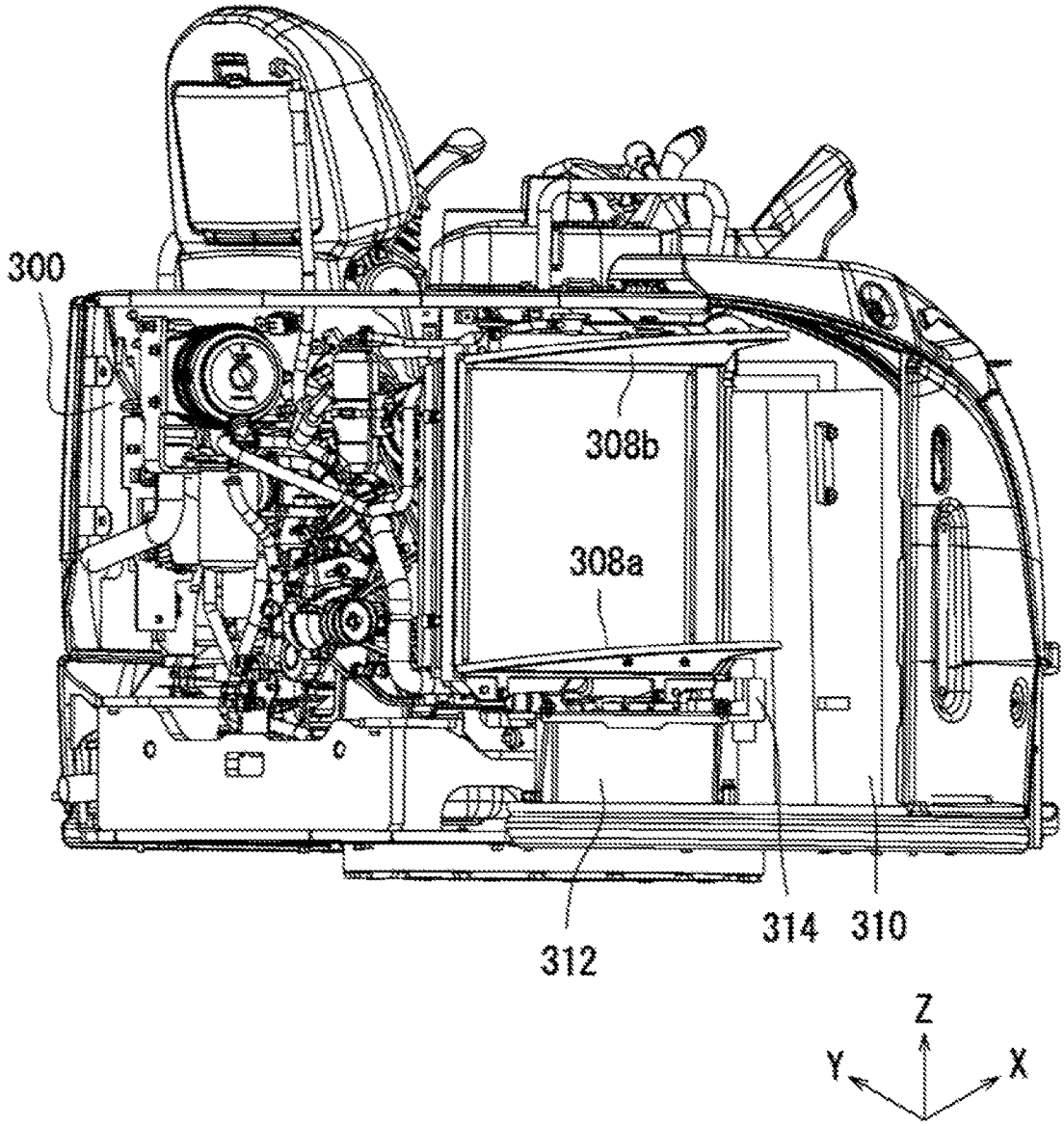
FIG. 6 is a view showing another example of the arrangement of the battery and the fuse box.
Figure 7:
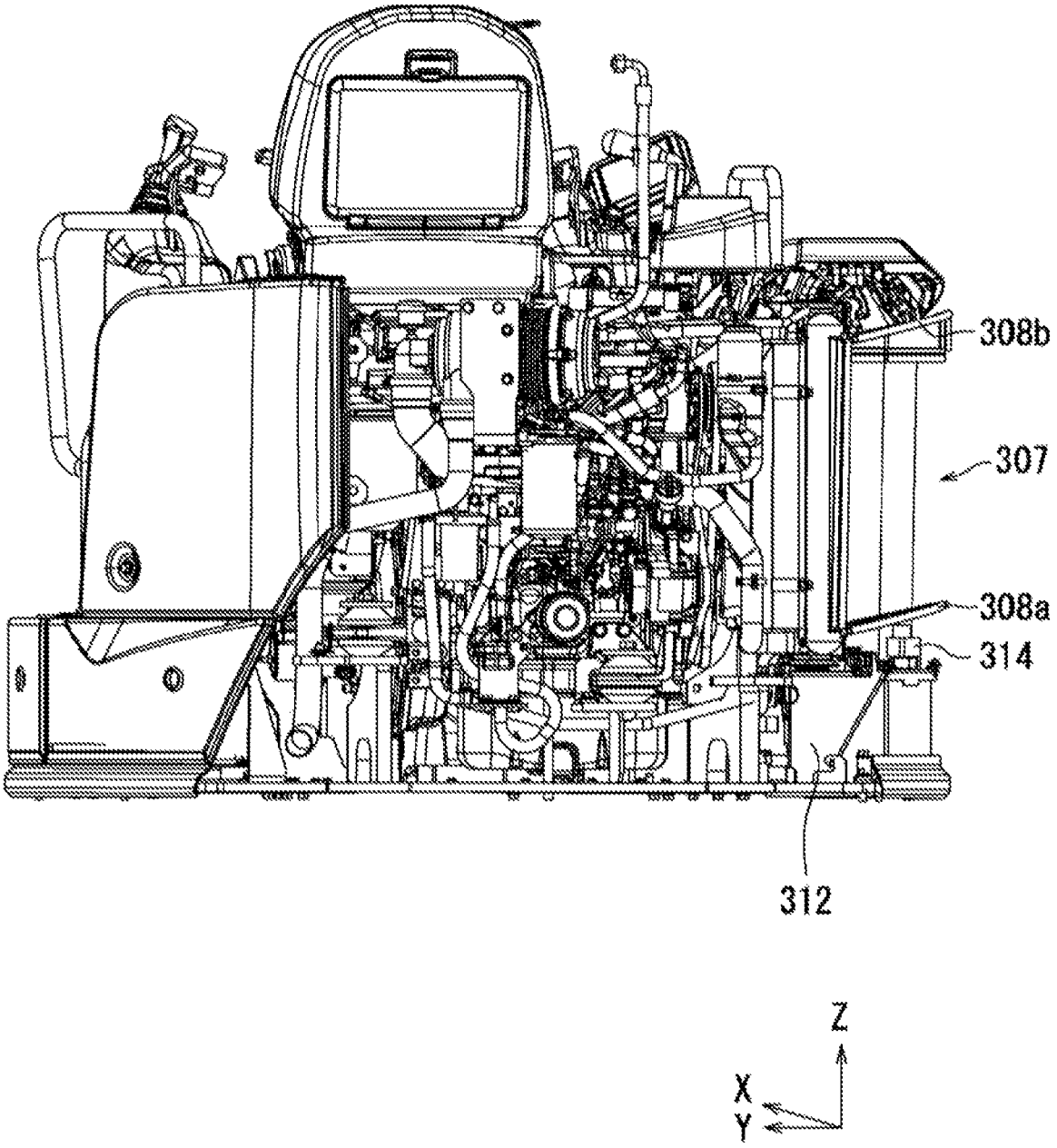
FIG. 7 is a view showing the battery and the fuse box of FIG. 6 from another direction.

Next, another example of the arrangement of the battery 312 and the fuse box 314 will be described with reference to FIGS. 1 to 3, 6, and 7. FIG. 6 is a view showing another example of the arrangement of the battery 312 and the fuse box 314. FIG. 7 is a view showing the battery 312 and the fuse box 314 of FIG. 6 from another direction.

As shown in FIGS. 6 and 7, the fuse box 314 is arranged, together with the battery 312, at a position adjacent to the hood 121 in a space below the lower partition plate 308*a*. Specifically, the fuse box 314 is attached to the side surface of the hydraulic oil tank 310 adjacent to the battery 312.

Figure 8:
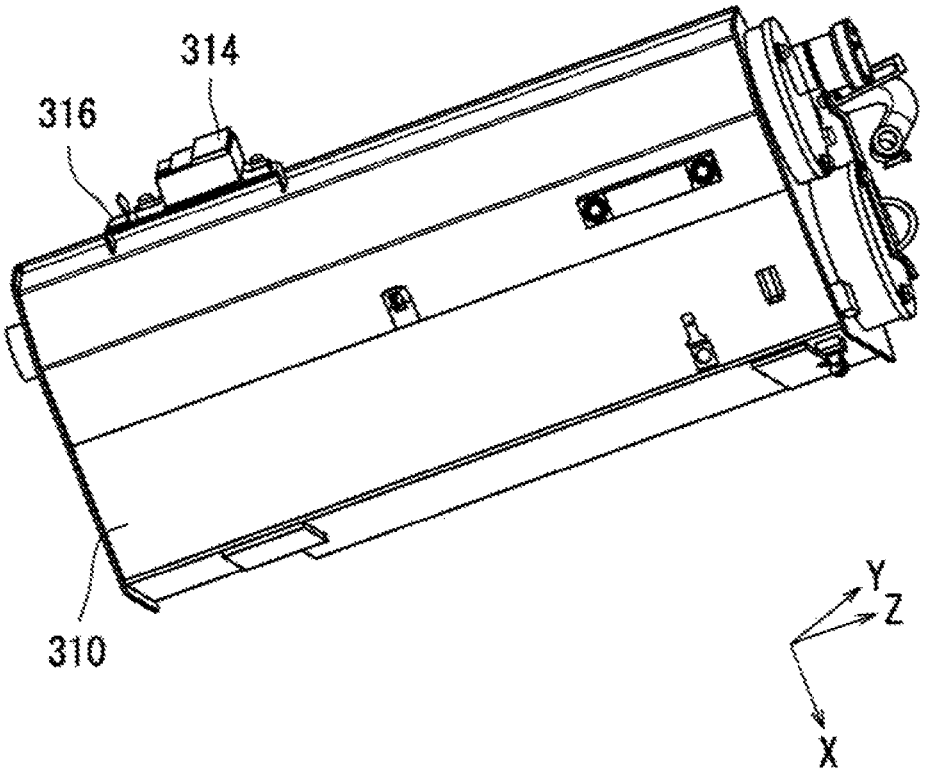
FIG. 8 is an enlarged perspective view of a hydraulic oil tank and the fuse box.
Figure 9:
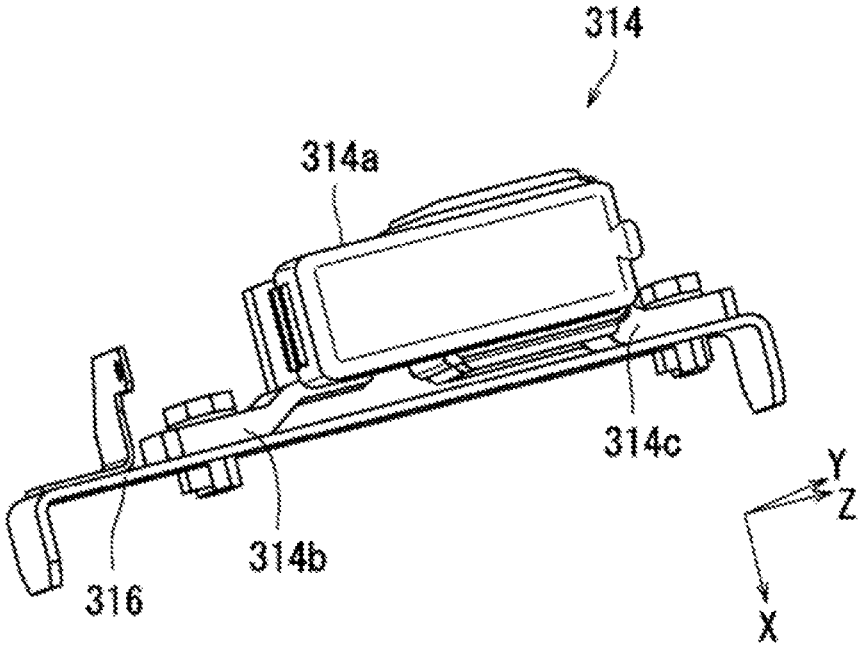
FIG. 9 is an enlarged perspective view of the fuse box and a mounting bracket.

FIG. 8 is an enlarged perspective view of the hydraulic oil tank 310 and the fuse box 314. FIG. 9 is an enlarged perspective view of the fuse box 314 and a mounting bracket 316.

As shown in FIGS. 8 and 9, the mounting bracket 316 is interposed between the fuse box 314 and the hydraulic oil tank 310. The fuse box 314 is attached to the surface of the mounting bracket 316 through the first attachment portion 314*b* and the second attachment portion 314*c*, and the center portion 314*a* is separated from the mounting bracket 316 in order to dissipate heat. The mounting bracket 316 has two legs, and these legs are welded to the side surface of the hydraulic oil tank 310.

According to the above-described embodiment, the lower partition plate 308*a* and the upper partition plate 308*b* form the air discharge passage 307, and the battery 312 is arranged in the space below the lower partition plate 308*a*. Moreover, the fuse box 314 is arranged between the lower partition plate 308*a* and the battery 312. Thus, the construction machine 100 of which the component layout efficiency in the engine room 300 is improved is provided. In addition, the fuse box 314 is easily accessible from the outside, and therefore, maintainability is improved.

The embodiment of the present invention has been described above with reference to the drawings. Note that the present invention is not limited to the above-described embodiment and can be implemented in various forms without departing from the gist of the invention. In addition, various aspects of the invention can be made by appropriately combining a plurality of components disclosed above in the embodiment. For example, some components may be omitted from all the components described in the embodiment. For the sake of easy understanding, the drawings schematically show each component, and, e.g., the number of each component shown may be different from an actual number for the sake of convenience in preparation of the drawings. In addition, each component described above in the embodiment is an example and is not particularly limited, and various changes can be made without substantially departing from the advantageous effects of the present invention.

In the embodiment, the heat exchanger arranged between the cooling fan 304 and the exhaust opening 200 is the radiator 306, but the present invention is not limited thereto. The heat exchanger may be an oil cooler for cooling hydraulic oil.

In the embodiment, the fuse box 314 is attached to the side surface of the hydraulic oil tank 310, but the present invention is not limited thereto. In a case where a fuel tank storing fuel for the engine 302 is located adjacent to the battery 312, the fuse box 314 may be attached to the side surface of the combustion tank.

INDUSTRIAL APPLICABILITY

The present invention is applicable to the field of construction machines.

LIST OF REFERENCE SIGNS

100 Construction Machine
121 Hood
200 Exhaust Opening
300 Engine Room
302 Engine
304 Cooling Fan
306 Radiator (Heat Exchanger)
307 Air Discharge Passage
308*a* Lower Partition Plate
308*b* Upper Partition Plate
310 Hydraulic Oil Tank
312 Battery
312*a* Positive Terminal
312*b* Negative Terminal
314 Fuse Box
314*a* Center Portion
314*b* First Attachment Portion
314*c* Second Attachment Portion
316 Mounting Bracket

The invention claimed is:

1. A construction machine comprising:
an engine including an electric device;
a cooling fan coupled to the engine;
a hood that defines an exhaust opening;
a heat exchanger that is arranged between the cooling fan and the exhaust opening;
a partition plate that forms an air discharge passage between the heat exchanger and the exhaust opening;
a battery that is arranged in a space below the partition plate; and
a fuse box that is coupled to a circuit that is configured to couple the electric device and the battery to each other,
wherein the fuse box is arranged between the battery and the partition plate.

2. The construction machine according to claim 1, wherein the fuse box is attached to a surface of the partition plate.

3. The construction machine according to claim 2, wherein:
the fuse box includes:
a center portion; and
attachment portions at both ends, and
the fuse box is arranged on the partition plate through the attachment portions, and
the center portion is separated from the partition plate.

4. The construction machine according to claim 1, wherein the fuse box is arranged in a space between a positive terminal of the battery and a negative terminal of the battery.

5. The construction machine according to claim 1, wherein the fuse box is configured to house;
a first fuse that is configured to be connected to a discharge circuit configured to discharge a current of the battery; and
a second fuse that is configured to be connected to a charge circuit configured to charge the battery.

6. The construction machine according claim 1, wherein the partition plate is inclined upward in a direction from the heat exchanger toward the exhaust opening.

* * * * *